US005441021A

United States Patent [19]

Moore, II

[11] Patent Number: 5,441,021

[45] Date of Patent: Aug. 15, 1995

[54] VARIABLE VALVE ACTUATION CAMSHAFT

[75] Inventor: Ralph Moore, II, Anchorage, Ak.

[73] Assignee: Moore Variable Cam, Inc., Anchorage, Ak.

[21] Appl. No.: 332,267

[22] Filed: Oct. 31, 1994

[51] Int. Cl.[6] ..... F01L 13/00

[52] U.S. Cl. ..... 123/90.17; 123/90.6; 74/568 R

[58] Field of Search ..... 123/90.15, 90.16, 90.17, 123/90.18, 90.6; 74/568 R, 567

[56] References Cited

U.S. PATENT DOCUMENTS

| | | | |
|---|---|---|---|
| 1,527,456 | 2/1925 | Woydt et al. | 74/568 R |
| 2,057,354 | 10/1936 | Withers et al. | 123/90.17 |
| 2,888,837 | 6/1959 | Hellmann | 74/568 |
| 3,144,009 | 8/1964 | Goodfellow et al. | 123/90.17 |
| 4,388,897 | 6/1983 | Rosa | 123/90.17 |
| 4,498,352 | 2/1985 | Hedelin | 123/90.17 |
| 4,570,581 | 2/1986 | Titolo | 123/90.17 |
| 4,771,742 | 9/1988 | Nelson et al. | 123/90.17 |
| 5,033,327 | 7/1991 | Lichti et al. | 123/90.17 |
| 5,090,366 | 2/1992 | Gondek | 123/90.17 |
| 5,136,887 | 8/1992 | Elrod et al. | 123/90.17 |
| 5,178,105 | 1/1993 | Norris | 123/90.15 |
| 5,179,918 | 1/1993 | Gyurovits | 123/90.17 |
| 5,181,486 | 1/1993 | Gyurovits | 123/90.17 |

*Primary Examiner*—Henry C. Yuen
*Assistant Examiner*—Weilun Lo
*Attorney, Agent, or Firm*—Longacre & White

[57] ABSTRACT

A camshaft assembly for variably actuating poppet valves of an internal combustion engine in relation to angular velocity. Pairs of cam lobes are separated by centripetal acceleration thereby varying dwell to optimize fuel economy, power output and emissions over a wide range of operating speeds.

18 Claims, 3 Drawing Sheets

VARIABLE VALVE ACTUATION CAMSHAFT

BACKGROUND OF THE INVENTION

1. Field of the Invention

The invention concerns a camshaft for an internal combustion engine (ICE) having variable valve actuation. Specifically, the present invention concerns a camshaft wherein the amount of dwell varies with respect to the angular velocity of the ICE.

Varying dwell, or the duration a poppet valve is open, affects fuel economy at part load on the ICE (by varying the occurrence of inlet valve closure, i.e. earlier or later), low speed power output (by flattening the torque curve) and full throttle fuel economy (by varying inlet and outlet valve overlap), as well as reduces the emissions from the ICE.

Either early or late inlet valve closure can increase the efficiency of an ICE operating at part load. Reducing the overlap period of the inlet and outlet valves can improve part throttle performance of an ICE by minimizing interference between induction and exhaust cycles. The gains in performance are greatest while the ICE is at idle (i.e. when inlet manifold pressure is highest). On the other hand, increased valve overlap leads to reduced NOx emissions at higher loads on the ICE and increased hydrocarbon emissions at lower loads on the ICE.

Dwell is a function of the profile of a cam. A cam profile in which the cam maintains a valve in a fully lifted, i.e. open, position is considered to have a "long" dwell. Conversely, a cam profile which causes a valve to open and close within a relatively short period is considered to have a "short" dwell.

An engine with long dwell cams is generally characterized as demonstrating superior performance at relatively high angular velocities of the engine. Essentially, a long dwell camshaft eases engine breathing (i.e the ability to draw in a fresh charge of unburned fuel and air, as well as discharge spent combustion products). An engine with short dwell cams generally operates most efficiently at relatively low engine speeds where it is also desirable to limit the quantity of emissions such as carbon monoxide, unburned hydro-carbons, etc.

The primary disadvantage of conventional camshafts is the requirement of selecting a single cam profile which favors either high speed performance or low speed emissions. This disadvantage is particularly prominent in small displacement air-cooled engines which are generally operated for extended periods at both extremes.

Another aspect of the preset invention concerns the ability of a camshaft for an ICE to vary the relative timing between operating the intake and exhaust valves with respect to the angular velocity of the ICE. Relative valve timing according to the present invention may be accomplished either separately or in conjunction with the aforementioned variation in dwell.

2. Description of Related Art

A number of attempts to accomplish variable valve actuation have been attempted in the past.

Woydt et al. (U.S. Pat. No. 1,527,456) discloses a system for relatively rotating two adjacent cams actuating a common tappet. Disadvantages of the Woydt et al. arrangement are a dramatically weakened hollow cam member 21 (due to the presence of longitudinal slots 35), and the requirement for an external control system 26–29 to regulate operation of the system.

Hellmann (U.S. Pat. No. 2,888,837) discloses a system whereby an actuating rod 15 causes adjacent pairs of cooperating cams 7,8 to pivotally separate. Disadvantages of the Hellmann arrangement include the same weakness in the camshaft 1 and changes in the profile of the ramps up to the peaks of the cam lobes as the cams pivot with respect to the shaft.

Goodfellow et al. (U.S. Pat. No. 3,144,009) disclose a system similar to Woydt et al. in that a bulky, external control system 41 causes actuator shaft 39 to translate axially. The tapered surfaces of the actuator shaft 39 cause auxiliary cam elements 30,31 to protrude to change the profile of the cam to change.

Rosa (U.S. Pat. No. 4,388,897) discloses a system in which an axially movable wormed camshaft 1 rigidly supports primary cams 2 and rotatably supports secondary cams 3. Axial movement of the camshaft 1 causes both lateral and angular separation of the primary cams 2 with respect to the secondary cams 3.

Nelson et al. (U.S. Pat. No. 4,771,742) disclose a camshaft system similar to that of Woydt et al. and Goodfellow et al. Separation of camlobes 28,36 is electronically controlled with one or more microprocessors within a control unit 84. The primary disadvantage of Nelson et al. with respect to the present invention is the complexity, and hence expense, of the control arrangement.

Gondek (U.S. Pat. No. 5,090,366) discloses a system for splitting a pair of cams which control the hydraulic operation of a plurality of valves. However, the cam of Gondek indirectly actuates poppet valves of an ICE.

Norris (U.S. Pat. No. 5,178,105) discloses an arrangement including a cam follower and two camshafts to variably actuate a poppet valve. There is no suggestion of rotationally separating a pair of cams on a single camshaft to mutually operate a poppet valve.

SUMMARY OF THE INVENTION

In order to address the aforementioned requirements of an ICE, and to overcome the disadvantages of the prior art, an objective of the present invention is to provide a camshaft assembly which optimizes the dwell length with respect to the angular velocity of the ICE.

Another object of the present invention is to provide a camshaft assembly which is capable of replacing an original equipment camshaft without occupying additional space or requiring modification to the remaining components of an ICE.

Yet another object of the present invention is to provide variable valve actuation without the addition of electronic or hydraulic control systems.

A further object of the present invention is to vary the relative timing between the intake and exhaust valves of an ICE.

DESCRIPTION OF THE PREFERRED EMBODIMENT

Figure 1:
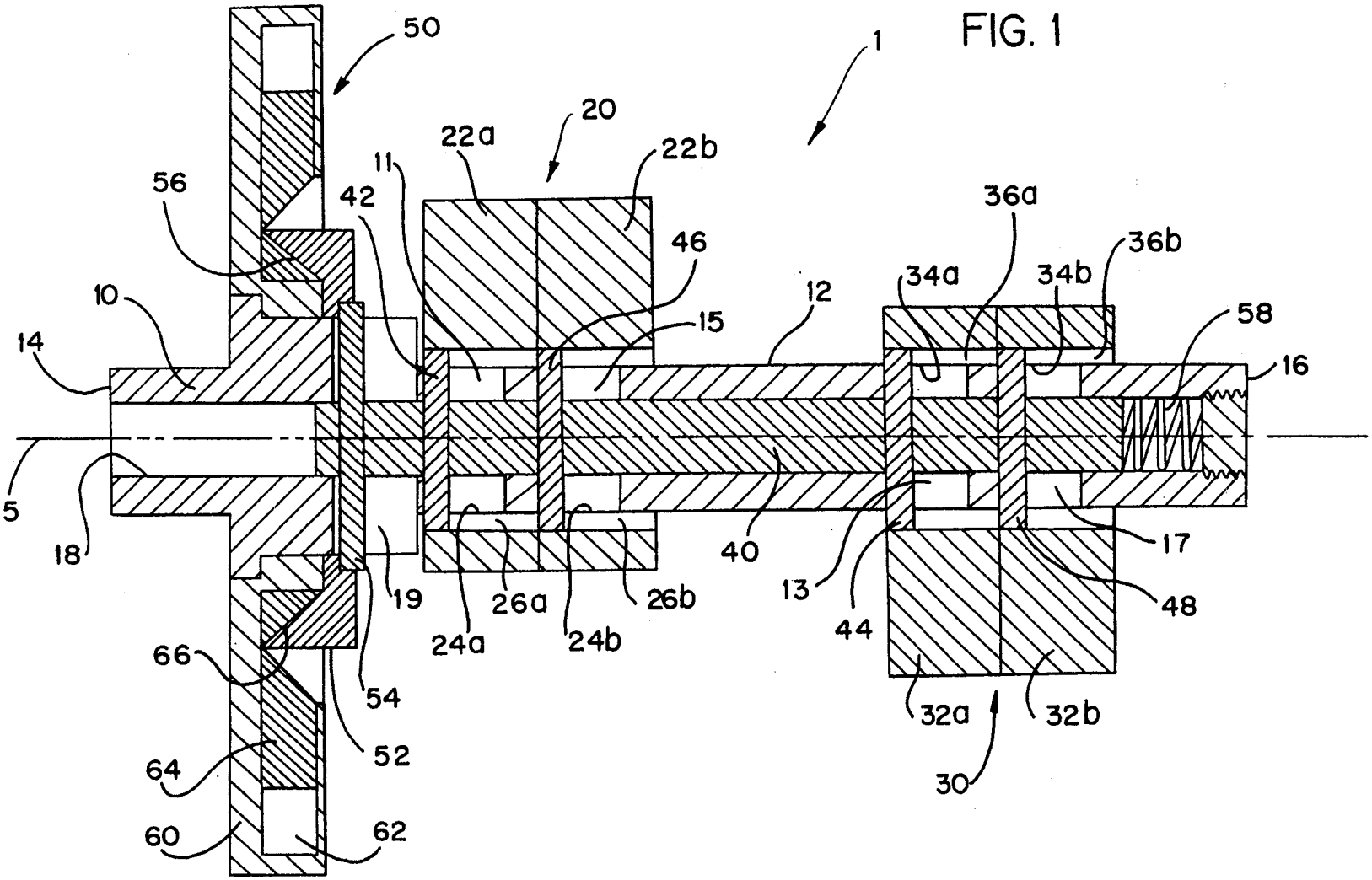
FIG. 1 is a longitudinal cross-section of a camshaft assembly according to the present invention.
Figure 2:
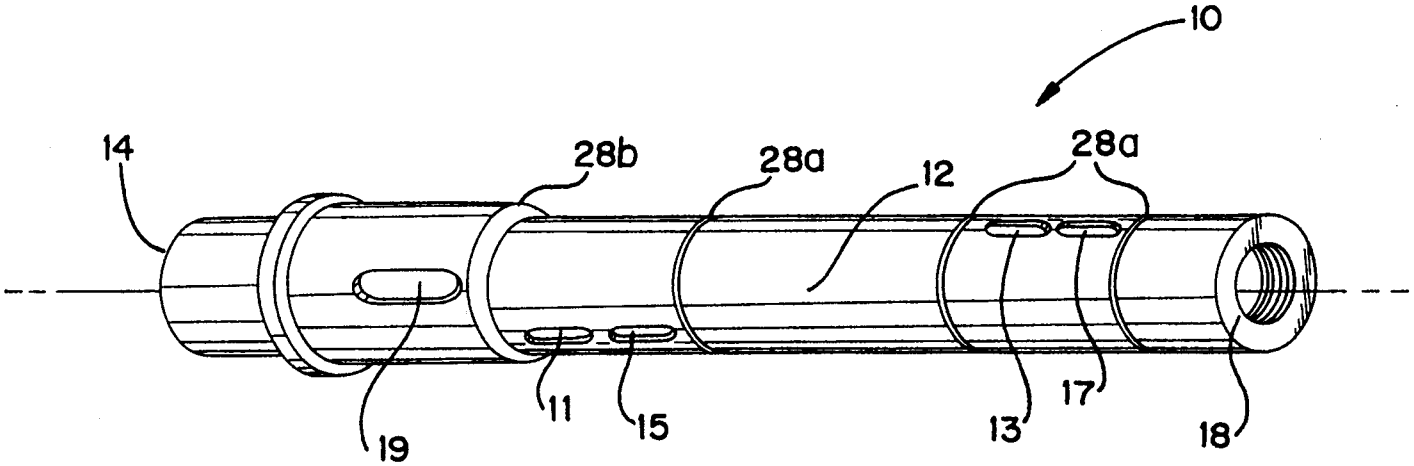
FIG. 2 is a perspective view of the camshaft illustrated in FIG. 1.
Figure 3:
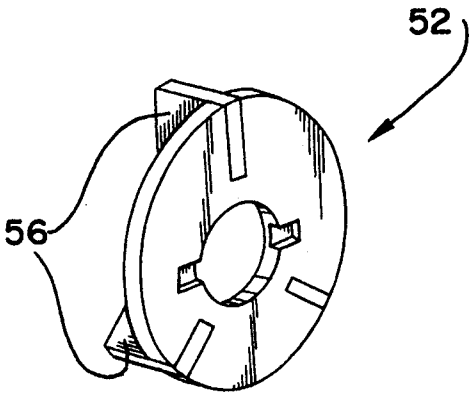
FIG. 3 is a perspective view of the actuator element illustrated in FIG. 1.
Figure 4:
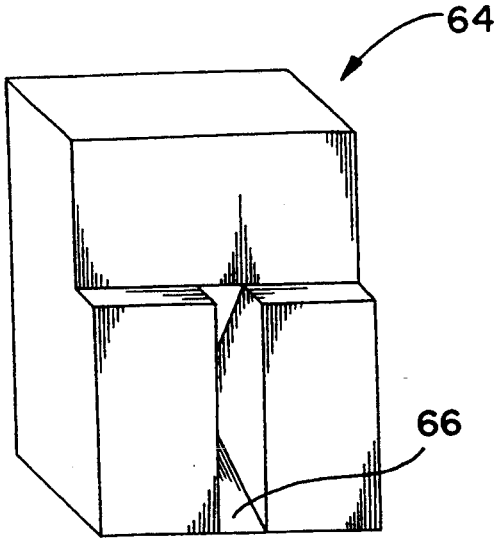
FIG. 4 is a perspective view of one of the weights illustrated in FIG. 1.

A camshaft assembly 1 according to the present invention is illustrated in FIGS. 1–5. The camshaft assembly 1 comprises an elongated camshaft 10 extending along a longitudinal axis 5. As particularly shown in FIG. 2, the camshaft 10 has a generally cylindrical exterior surface circumscribing the longitudinal axis 5, as well as a first axial end 14 and a second axial end 16. The camshaft 10 further includes a passage 18 extending along the longitudinal axis 5.

A first pair of cams 20 is supported on the camshaft 10 for operating a first poppet valve (not shown). The first pair of cams 20 includes a primary cam 22*a* which is relatively rotatable with respect to the camshaft 10. In particular, the primary cam 22*a* includes an interior surface 24*a* circumscribing and confronting the exterior surface 12. The primary cam 22*a* also includes a groove(s) 26*a* which will be described in greater detail hereafter. The first pair of cams 20 also includes a secondary cam 22*b* which may or may not be relatively rotatable with respect to the camshaft 10. In instances where the secondary cam 22*b* is rotatable with respect to the camshaft 10, the secondary primary cam 22*b* includes an interior surface 24*b* circumscribing and confronting the exterior surface 12, as well as a groove(s) 26*b* which will be described in greater detail hereafter.

A second pair of cams 30 is supported on the camshaft 10 for operating a second poppet valve (not shown). The second pair of cams 30 includes a primary cam 32*a* which is relatively rotatable with respect to the camshaft 10. In particular, the primary cam 32*a* includes an interior surface 34*a* circumscribing and confronting the exterior surface 12. The primary cam 32*a* also includes a groove(s) 36*a* which will be described in greater detail hereafter. The second pair of cams 30 also includes a secondary cam 32*b* which may or may not be relatively rotatable with respect to the camshaft 10. In instances where the secondary cam 32*b* is rotatable with respect to the camshaft 10, the secondary cam 32*b* includes an interior surface 34*b* circumscribing and confronting the exterior surface 12, as well as a groove(s) 36*b* which will be described in greater detail hereafter.

An actuator rod 40 extends along the longitudinal axis 5 within the passage 18. The actuator rod 40 includes a first lateral projection 42, which extends through an aperture 11 piercing the camshaft 10, and engages the groove(s) 26*a*. The actuator rod 40 also includes a second lateral projection 44, which extends through an aperture 13 piercing the camshaft 10, and engages the groove(s) 36*a*.

In the illustration of the present invention, the secondary cams 22*b*,32*b* also rotate relative to the camshaft 10. As such, the actuator rod 40 includes a third lateral projection 46, which extends through an aperture 15 piercing the camshaft 10, and engages the groove(s) 26*b*. The actuator rod 40 further includes a fourth lateral projection 48, which extends through an aperture 17 piercing camshaft 10, and engages the groove(s) 36*b*.

The actuator rod 40 is axially shifted along the longitudinal axis 5 by a centrifugal means 50 which is responsive to the angular speed of the camshaft assembly 1. The illustrated centrifugal means 50 includes an actuator element 52 connected to the actuator rod 40 by a link 54 which extends through an aperture 19 piercing the camshaft 10.

A drive gear 60 is keyed to the camshaft 10 so as to be non-rotatably fixed. The drive gear 60 includes a number of weight pockets 62 which are radially elongated and open axially toward the actuator element 52. Each weight pocket 62 retains a weight 64 having a first face 66 which slidably engages a corresponding second face on the actuator element 52.

Axially shifting the actuator rod 40 is accomplished as a result of sliding engagement between the first faces 66 and the second faces 56. Centripetal acceleration as a consequence of increased angular speed of the camshaft 10 causes the weights 64 to move radially outward, i.e. away from the longitudinal axis 5. Because the faces 56,66 are obliquely inclined with respect to the longitudinal axis 5, radial movement of the weights 64 is converted into axial movement of the actuating element 52, link 54 and actuating rod 40.

Relative radial rotation of the primary cams 22*a*,32*a* with respect to the secondary cams 22*b*,32*b* is accomplished as follows. As illustrated, the apertures 11,13,15,17 extend parallel to the longitudinal axis 5, and the grooves 26*a*,26*b*,36*a*,36*b* are helical cut into the interior surfaces 24*a*,24*b*,34*a*,34*b*, respectively. By varying the pitch and/or direction of the grooves 26*a*,26*b*,36*a*,36*b*, axial movement of the lateral projections 42,44,46,48 causes the primary cams 22*a*,32*a* to rotate relative to the secondary cams 22*b*,32*b*. Retaining rings located in grooves 28*a* formed in the exterior surface 12, as well as a shoulder 28*b*, maintain the relative axial position of the cams. It is noted that by varying the pitch and/or direction of the grooves 26*a*,26*b* with respect to the grooves 36*a*,36*b*, variations in timing between the first and second pairs of cams 20,30 may be obtained.

Figure 5:
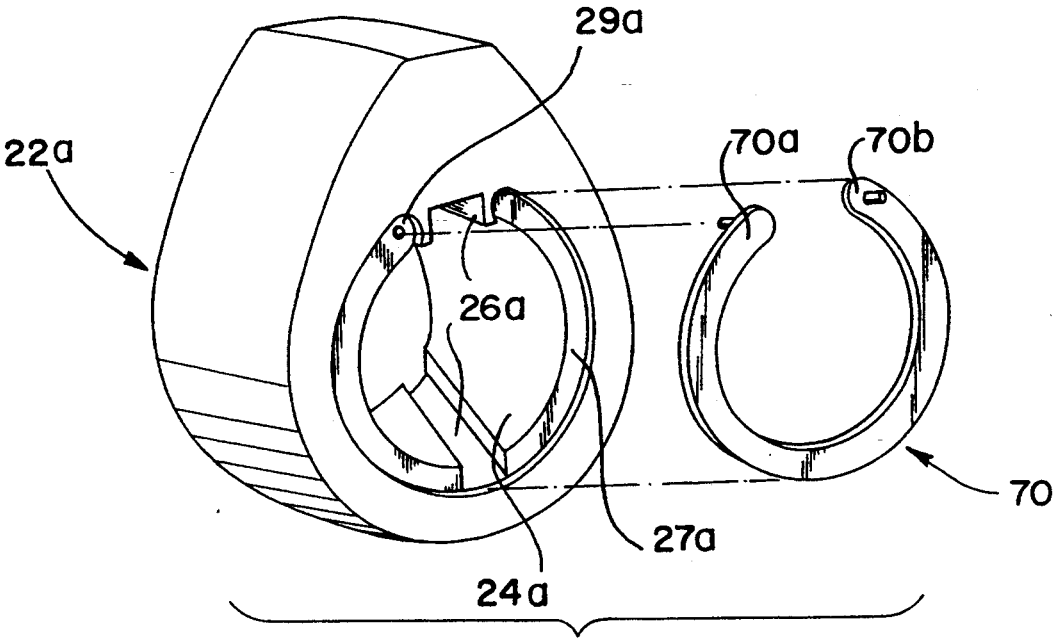
FIG. 5 is a perspective view of one of the cams illustrated in FIG. 1, as well as a resilient means.

FIG. 5 shows the primary cam 22*a* (the primary cam 32*a* is equivalent) including interior surface 24*a* and groove(s) 26*a*. The primary cam 22*a* also includes an axially facing recess 27*a* which at least partially receives a resilient means 70 for angularly biasing the primary cam 22*a* with respect to the secondary cam 22*b*. In particular, a first end 70*a* of the resilient means 70, e.g. an arcuate spring, is attached to the primary cam 22*a* at connection 29*a* and a second end 70*b* of the resilient means 70 is similarly attached to the secondary cam 22*b*.

In addition to the resilient means 70 axially interposed between the pairs of primary and secondary cams, a return means 58 such as spring may bias the actuating rod 40 to its original position.

A number of variations in the basic arrangement of the present invention are envisioned within the scope of the present invention. The passage 18 need not be centrally located around the longitudinal axis 5, but may instead constitute a groove cut in the exterior surface 12. In such a case, the actuating rod 40 would still slide in the surface groove, however the lateral projections 42,44,46,48 need not pierce the camshaft 10.

Another alternative would be to use helical apertures 11,13,15,17 and straight grooves 26*a*,26*b*,36*a*,36*b*. In this case, it would be necessary to segment the actuator rod 40 such that portions including each of the lateral projections 42,44,46,48 could rotate relative to one another about the longitudinal axis 5.

Resilient elements could also be placed within the weight pockets 62 to bias the weights 64.

Although the weight pockets 62 have been illustrated opening toward the pairs of cams 20,30 such that centripetal acceleration pushes the actuator rod 40 toward the second axial end 16, the weight pockets 62 may also open from the opposite side of the drive gear 60 such that the centripetal acceleration would pull the actuator rod 40 toward the first axial end 14.

What is claimed is:

1. A camshaft for an internal combustion engine, the camshaft rotates about a longitudinal axis, the camshaft includes a generally cylindrical exterior surface circumscribing the longitudinal axis as well as first and second axial end surfaces which are generally orthogonal to the longitudinal axis, the camshaft comprising:

a passage extending parallel to the longitudinal axis;

a first pair of cams, at least a primary one of said first pair of cams is rotatably supported on the exterior surface, said primary one of said first pair of cams includes a first primary interior surface circumscribing and confronting said exterior surface, said primary one of said first pair of cams further includes a first primary groove in said first primary interior surface;

a second pair of cams, at least a primary one of said second pair of cams is rotatably supported on the exterior surface, said primary one of said second pair of cams includes a second primary interior surface circumscribing and confronting said exterior surface, said primary one of said second pair of cams further includes a second primary groove in said second primary interior surface;

an actuator rod extending in said passage, said actuator rod includes a first lateral projection engaging said first primary groove and a second lateral projection engaging said second primary groove; and centrifugal means for causing displacement of said actuator rod parallel to the longitudinal axis as a consequence of changes in angular speed of the camshaft;

wherein changes in angular speed of the camshaft cause longitudinal displacement of said actuator rod with said first and second lateral projections, in turn the longitudinal displacement of said first and second lateral projections cause both said primary one of said first pair of cams and said primary one of said second pair of cams to rotate relative to the camshaft.

2. The camshaft according to claim 1, wherein said passage is centrally located so as to be coincident with the longitudinal axis.

3. The camshaft according to claim 2, further comprising:

a plurality of apertures extending from said passage to the exterior surface of the camshaft, said apertures are elongated such that a majority component of said aperture extends along the longitudinal axis.

4. The camshaft according to claim 1, wherein said first primary groove and said second primary groove are helical.

5. The camshaft according to claim 4, further comprising:

a plurality of apertures extending from said passage to the exterior surface of the camshaft, said apertures are elongated parallel to the longitudinal axis.

6. The camshaft according to claim 1, wherein said first primary groove and said second primary groove extend parallel with respect to the longitudinal axis, and said passage is centrally located so as to be coincident with the longitudinal axis.

7. The camshaft according to claim 6, further comprising:

a plurality of apertures extending from said passage to the exterior surface of the camshaft, said apertures are helical shaped with respect to the longitudinal axis;

wherein said actuator rod is articulated such that relative angular orientation of said first and second lateral projections with respect to the longitudinal axis is variable.

8. The camshaft according to claim 1, further comprising:

a secondary one of said first pair of cams; and a secondary one of said second pair of cams;

wherein said secondary one of said first pair of cams and said secondary one of said second pair of cams are fixed with respect to the camshaft.

9. The camshaft according to claim 1, further comprising:

a secondary one of said first pair of cams; and a secondary one of said second pair of cams;

wherein said secondary one of said first pair of cams and said secondary one of said second pair of cams are rotatable with respect to said primary one of said first pair of cams and said primary one of said second pair of cams, respectively, as well as the camshaft.

10. The camshaft according to claim 9, further comprising:

resilient means for angularly biasing said primary ones of said first and said second pairs of cams with respect to said secondary ones of said first and said second pairs of cams, respectively.

11. The camshaft according to claim 10, wherein said resilient means are arcuate shape springs having a first end attached to said primary ones of said first and said second pairs of cams, and a second end attached to said secondary ones of said first and said second pairs of cams.

12. The camshaft according to claim 1, further comprising:

a drive gear fixed to said camshaft for concomitant rotation about the longitudinal axis, said drive gear including at least one radially elongated pocket;

wherein said centrifugal means include:

a weight slidably disposed in each said at least one pocket, said weight having an oblique first face with respect to the longitudinal axis; and an actuator element having a second face slidably engaging said first face, said actuator element is operatively connected to said actuator rod;

wherein changes in angular velocity of said drive gear cause radial displacement of said weight, in turn this causes longitudinal displacement of said actuator element and said actuator rod as a consequence of said first face sliding relative to said second face.

13. The camshaft according to claim 12, wherein said centrifugal means further includes resilient means for radially retracting said weight toward the longitudinal axis.

14. The camshaft according to claim 12, wherein said first face and said second face have the same oblique orientation with respect to the longitudinal axis such that said first and said second faces slide parallel with respect to one another.

15. The camshaft according to claim 12, wherein said first face and said second face are both obliquely oriented at 45° with respect to the longitudinal axis.

16. The camshaft according to claim 12, further comprising:

a link connecting said actuator element and said actuator rod, said link is axially positioned between the first and second axial end surfaces;

wherein said actuator element is axially positioned between said link and said drive gear, said weight is axially positioned between said drive gear and said actuator element, and said drive gear is axially proximate to the first axial end surface.

17. The camshaft according to claim 16, wherein said passage is centrally located so as to be coincident with the longitudinal axis, and said link extends into said passage through at least one penetration in the exterior surface.

18. The camshaft according to claim 17, further comprising:

return means for axially displacing said actuator rod toward the first axial end surface, said return means is axially proximate to the second axial end surface.

* * * * *